US005819694A

United States Patent [19]

Trutescu et al.

[11] Patent Number: 5,819,694

[45] Date of Patent: Oct. 13, 1998

[54] STAMPED ROLLER-TYPE CAM FOLLOWERS WITH ADDED HEIGHT

[75] Inventors: Tomi Trutescu, Greenlawn; Victor Nicolescu, Ramsey; Frank Bruno, Sr., Jersey City, all of N.J.

[73] Assignee: Welles Manufacturing Company, Northvale, N.J.

[21] Appl. No.: 856,912

[22] Filed: May 15, 1997

[51] Int. Cl.[6] ..... F01L 1/18; F01L 1/24

[52] U.S. Cl. ..... 123/90.43; 123/90.39; 123/90.42; 123/90.46; 74/519; 74/559

[58] Field of Search ..... 123/90.39, 90.4, 123/90.41, 90.42, 90.43, 90.44, 90.45, 90.46; 74/519, 559

[56] References Cited

U.S. PATENT DOCUMENTS

| | | | |
|---|---|---|---|
| 2,385,309 | 9/1945 | Spencer | 74/519 |
| 2,435,727 | 2/1948 | Spencer | 74/569 |
| 4,614,171 | 9/1986 | Malhotra | 123/90.44 |
| 4,628,874 | 12/1986 | Barlow | 123/90.5 |
| 4,697,473 | 10/1987 | Patel | 74/519 |
| 4,796,483 | 1/1989 | Patel | 74/519 |
| 4,825,717 | 5/1989 | Mills | 74/519 |
| 4,829,647 | 5/1989 | Anderson et al. | 29/156.4 R |
| 4,848,180 | 7/1989 | Mills | 74/519 |
| 4,913,104 | 4/1990 | Mills | 123/90.4 |
| 4,940,048 | 7/1990 | Mills | 123/90.39 |
| 5,010,856 | 4/1991 | Ojala | 123/90.36 |
| 5,016,582 | 5/1991 | Mills | 123/90.39 |
| 5,123,384 | 6/1992 | Abbas | 123/90.39 |
| 5,372,097 | 12/1994 | Joseph et al. | 123/90.36 |
| 5,655,490 | 8/1997 | Nagano et al. | 123/90.41 |
| 5,678,305 | 10/1997 | Nagano et al. | 123/90.39 |

*Primary Examiner*—Weilun Lo
*Attorney, Agent, or Firm*—Handal & Morofsky

[57] ABSTRACT

The invention provides a new roller-type cam follower for transmitting valve-opening impulses from an overhead camshaft of an internal combustion engine. The follower has an integral, one-piece cold-formed cam follower body with a U-shaped, cam-facing cross-section at a support end of the follower which rides on a valve lifter post. Added height is provided by the combination of an inverted U-shaped cross-section of the movable, valve-engaging end of the follower with a separate insert secured into its section. The insert can be arcuate or spring-like and can be attached to a movable end of the cam follower or can be a cup-like insert attached to a support end of the follower. A cam follower with novel oiling structure is also disclosed.

20 Claims, 5 Drawing Sheets

STAMPED ROLLER-TYPE CAM FOLLOWERS WITH ADDED HEIGHT

BACKGROUND OF THE INVENTION

1. Field of the Invention

The present invention relates to stamped, roller-type cam followers such as are used in overhead-cam internal combustion engines to operate intake and exhaust valves controlling the passage of combustion and exhaust gases to and from the engines' cylinders. In general, while not being limited thereto, the invention is primarily applicable to internal combustion engines for automobiles. More particularly, the invention provides a novel stamped, roller-type cam follower, and embodiments thereof which have added height and other advantages.

2. Description of Related Art Including Information Disclosed under 37 CFR 1.97 and 37 CFR 1.98

Cam followers operate by translating driving impulses received from eccentric lobes on the cam into reciprocatory motion of the valve stems of the valves. Roller-type cam followers, also known as "rocker arms", comprise an elongated body having a first end supported on a valve lifter post and a second end engaging and driving a valve stem against the action of a valve spring. Intermediately its ends the elongated body carries a follower roller journaled in bearings to engage and follow the profile of a lobe of an overhead camshaft mounted for rotation in cam bearings above the follower body. Eccentricity provided by a laterally projecting lobe on the camshaft imparts a reciprocatory motion to the follower roller causing the follower to pivot about the lifter post and reciprocate the valve stem.

Stamping from sheet or strip material is a preferred and economical process for manufacturing a one-piece cam follower body to provide a lightweight, esthetic product which is generally considered superior to heavier cast followers produced by older technology. Additional features may be provided by performing further cold-forming steps, as is known to those skilled in the art. Typically, the cam follower body has a support end which rests on a lifter post and a movable end that engages the valve stem. Some examples of cold-formed cam followers or rocker arms are disclosed in Joseph et al. U.S. Pat. No. 5,372,097 and Mills U.S. Pat. No. 5,048,475.

Generally, the overall shape of the stamped follower is a U-shaped channel, with the opening pointing upward, toward the camshaft or downward ("inverted U") toward the cylinder head, depending upon the relative location of other valve train components and also upon necessary clearances from these components and to other fixed or movable engine components. In circumstances where these considerations make it impractical to employ an inverted U-shaped follower, a difficulty arises in cold forming the valve-engaging movable end of the follower. A preferred shape of such a movable end has a cross section in the shape of the letter H, the lower walls of which embrace the valve and guide the follower on the valve, locating it laterally. The height of the lower walls is obtained by stamping the metal in an opposite direction relative to the general stamping direction and is limited by metallurgical considerations: if the material is pressed too deeply, it may break or exhibit unacceptable weakness. There is accordingly difficulty in providing a U-shaped cam follower which has adequate height of such lower walls.

Another difficulty relates to adequate oiling of the following, especially where it rides on the valve stem with some degree of lateral movement relative to the stem.

Inadequate lubrication may lead to premature wear of the valve stem or cam follower, causing timing problems. While Joseph et al. provides one solution to lubrication problems for cold-formed cam followers, other solutions would be desirable.

SUMMARY OF THE INVENTION

The invention, as claimed, is intended to provide a remedy. In one aspect, it solves the problem of providing a cold-formed cam follower with adequate height, and in another aspect it solves the problem of providing adequate lubrication in a novel manner.

Accordingly, the invention provides, in one aspect, a roller-type, internal combustion engine cam follower for an overhead cam engine having a camshaft located above a plurality of engine valves, the cam follower comprising:

a) a cold-formed one-piece cam follower body having:
   i) a U-shaped support end to support the cam follower on a lifter post in a generally upright position with respect to the lifter post the support end having;
   ii) a movable end to engage a valve stem; and
   iii) a cutout between said support end and said movable end; and b) a roller mounted on the cam follower body to extend through the cutout for engagement with a cam;

wherein the movable end has an inverted U-shaped section defined between side walls having terminal ends the opening toward the engine valve.

In a preferred embodiment, the cam follower comprises a valve-contacting insert element comprises an insert positioned in the inverted U-shaped section of the movable end to be engageable with the valve stem.

By employing such an insert, a cam follower having the lightness and economy provided by cold forming can be provided with the functional advantages of high side walls, enhancing the stability of the valve-follower system. Surprisingly, the advantages attributable to employment of the defined follower insert, especially with regard to increased engine design flexibility, have been found to outweigh its material and manufacturing costs.

In one embodiment, the movable end has an inverted channel-shaped structure and the insert conforms with and is located in said inverted channel-shaped structure and is positioned for engagement with the valve stem.

In another embodiment, the movable end is upwardly open and comprises integral side walls and a bottom wall extending between the side walls, and wherein the height enhancer element comprises a resilient clip fitted over the bottom portion.

In another aspect, the invention provides a roller-type, internal combustion engine cam follower comprising:

a) a cold-formed cam follower body having:
   i) a support end to support the cam follower on a lifter post in a generally upright position with respect to the lifter post;
   ii) an upwardly and endwardly open movable end having side walls and a bottom wall between said side walls to engage a valve stem; and
   iii) a cutout between said support end and said movable end;

b) a roller mounted on the cam follower body to extend through the cutout for engagement with a cam; and c) extensions of said side walls wrapping around an open end of the cam follower body to retain oil wherein an oil feed slot is defined between the extensions through which oil can feed downwardly to the valve stem.

The novel side wall extensions combined with the recited follower structure provide an advantageous oiling structure which does not apply viscous drag to the follower roller.

BRIEF DESCRIPTION OF THE DRAWINGS

Some illustrative and exemplary embodiments, or aspects of the invention, and the best mode contemplated of carrying out the invention as it pertains to those embodiments or aspects, are described in detail below, with reference to the accompanying drawings in which.

DETAILED DESCRIPTION OF THE PREFERRED EMBODIMENTS

Figure 1:
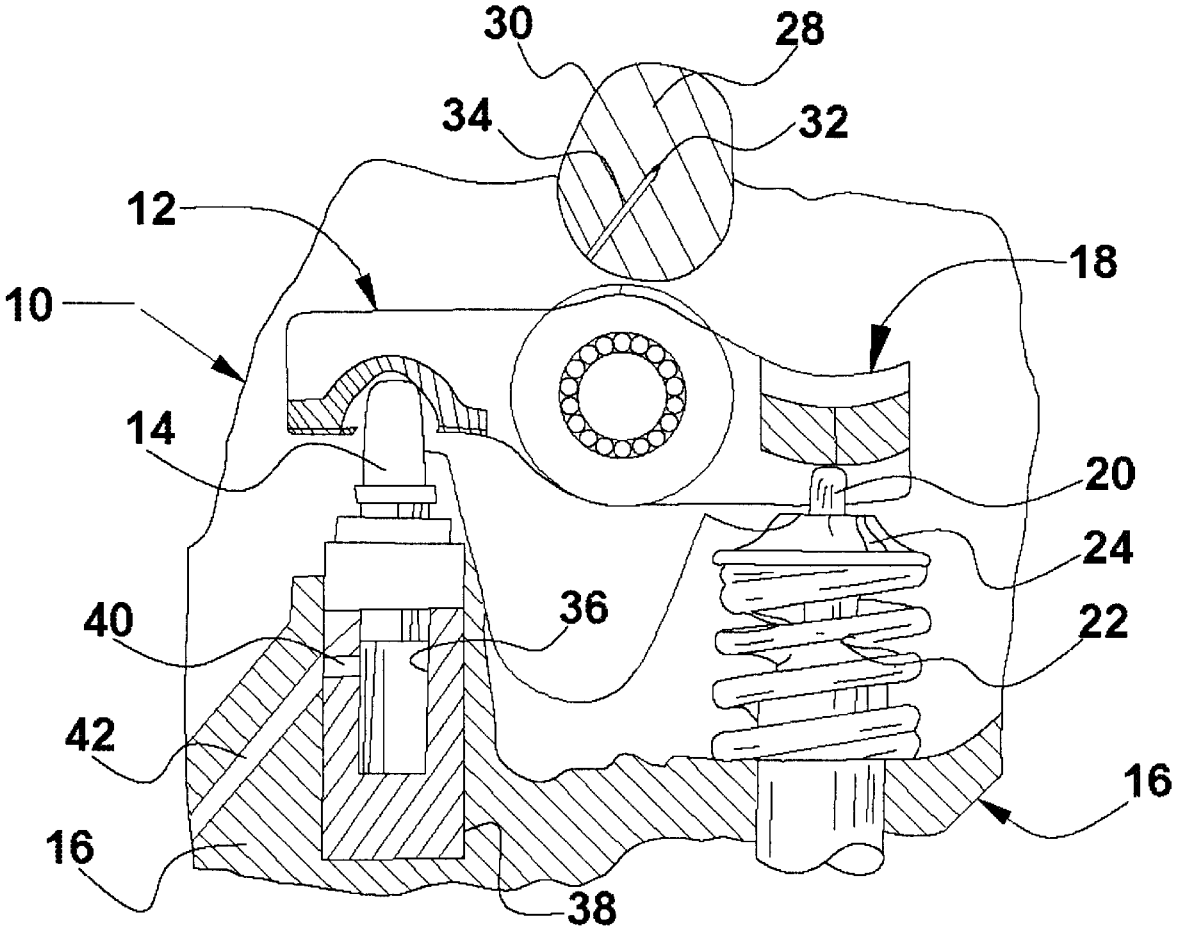
FIG. 1 is a schematic view, partly in section, of a valve-actuating mechanism for an overhead cam internal combustion engine employing a first embodiment of a roller-type cam follower according to the invention.

Referring to FIG. 1, a roller-type cam follower comprises an integral, one-piece cam follower body 10 which has a support end 12 seated on a lifter post 14, which lifter post 14 extends upwardly from a cylinder head 16, and has a movable end 18 which engages an upper end of a valve stem 20, the engagement being effected in this embodiment by means of a novel insert described in detail below. With the orientation shown, the cam follower may be said to have a generally upright position with respect to lifter post 14 and terms such as "upright", "upward", "upper", "downward", "underside" and "inverted" are similarly used with respect to such a generally upright position.

Valve stem 20 also extends upwardly from cylinder head 16, in this case, through a compressible valve spring 22. Valve spring 22 acts between cylinder head 16 and a retainer ring 24 mounted on valve stem 20 to urge closure of the valve at its lower end in a combustion chamber or cylinder (not shown), disposed beneath cylinder head 16. Valve spring 22, acting on retainer ring 24, also supports the upper end of valve stem 20 and urges it into engagement with movable end 18 of cam follower body 10.

Intermediately of its length, cam follower body 10 carries a roller 26 which rolls on an overhead cam 28 which is rotated by a drive (not shown) from the engine. An eccentric timing lobe 30 on cam 28 acts on cam follower roller 26, depressing the cam follower and causing it to pivot about lifter post 14. The movable end 18 of cam follower body 10 drives the valve stem 20 downwardly against valve spring 22 to open the valve, which returns to a closed position under influence of the valve spring 22 when the cam follower roller 26 finds the dwell portion of the cam profile defined by timing lobe 30. Such a construction is sometimes known as an inverted cam follower design because the cam follower is beneath the cam, rather than riding on top of it.

In the construction shown, oil is supplied through a central passage 32 in the cam 28 and through radial bleed holes such as 34, whence it flows to the roller 26 and the cam follower 10. The lifter post 14 is slidably carried in a chamber 36 formed in a tubular insert 38 mounted in cylinder head 16, and is cushioned by pressurized oil admitted into chamber 36 through a small port 40 from a supply passage 42. Also called a lash adjuster, the lifter post 14 can yield to a limited extent, in response to a down thrust from the advancing timing lobe 30, to provide an adequate lash adjustment for the cam follower.

Figure 2:
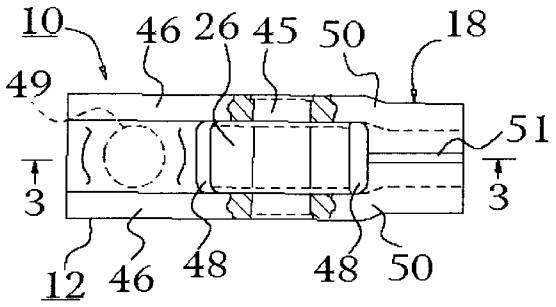
FIG. 2 is a top plan view, also partly sectioned, of the cam follower shown in FIG. 1.
Figure 3:
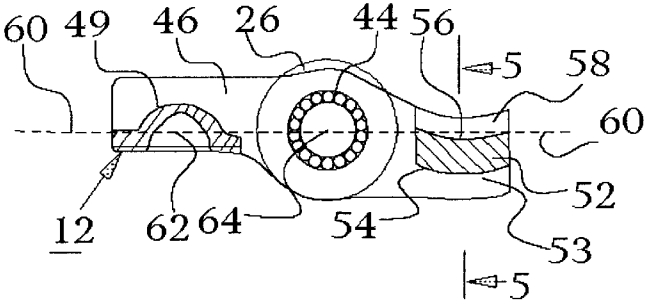
FIG. 3 is a section on the line 3—3 of FIG. 2.
Figure 4:
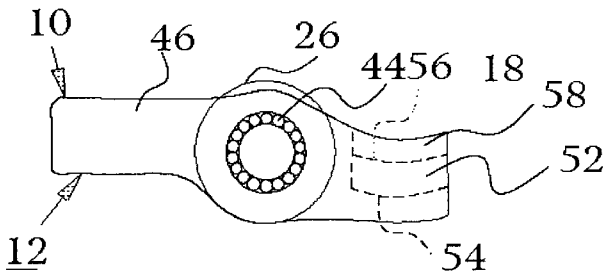
FIG. 4 is a side elevation of the cam follower shown in FIG. 2.

Referring to FIGS. 2–5, cam follower roller 26, moves on needle bearings 44 and, as shown by the sectioning in FIG. 2, is carried on a shaft 45 journaled into side walls 46. As is apparent from the side views in FIGS. 1, 3 and 4, roller 26 projects upwardly beyond side walls 46 for engagement with cam 28 while, downwardly, roller 26 is accommodated in a cutout 48. Cutout 48 preferably is large enough to provide good clearance from roller 26, such as to avoid viscous drag on the roller caused by oil retained in the cutout. Side walls 46 have a reduced spacing toward movable end 18, providing shoulders 50 which add rigidity to the cam follower body 10, and are separated by a slit 51 in the sheet metal from which follower body 10 is fabricated, so that movable end 18 is, in effect, bifurcated.

Figure 5:
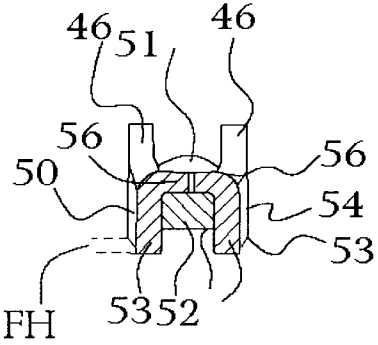
FIG. 5 is a sectional view on the line 5—5 of FIG. 3.

At support end 12, cam follower body 10 has an upwardly open channel-like configuration with an upright, U-shaped section, looking from the left, toward roller 44, which is interrupted by a domed cap 49 that is a close fit over lifter post 14 (FIG. 1). By contrast, as best shown in FIG. 5, movable end 18 has an inverted, U-shaped section which is partially in-filled by an arcuately shaped follower insert 52. The inverted U-shaped section is symmetrical about a center line and is created by bending of the vertical walls toward the center line of the follower. Side walls 46 have lower extremities 53, constituted by terminal portions of the side walls 46 and depending downwardly past insert 52 to embrace valve stem 20 and locate the cam follower laterally relatively thereto.

Side walls 46 have significant height in the vicinity of roller 26 for rigidity and bearing support. As may be seen from FIG. 3, side walls 46 have a generally rectangular configuration in the vicinity of support end 12, and extend parallel to the axis 60.

Insert 52 is a separate or added piece attached to follower body 10 and is a close fit between side walls 46 where it is secured in place by welding, brazing, adhesive or the like, the close fit being facilitated by slit 51. Insert 52 is dimensioned with a depth that leaves side walls 46 with downwardly depending extremities 53 of significant height. Follower insert 52 presents a convexly curved downward face 54 to ride on valve stem 20. Insert 52 is preferably formed from laminar strip or sheet material and has a concavely curved upper face 56. Movable end 18 of cam follower body 10 has a matching curved portion 58, whose conformation helps strengthen the cam follower and resist the lengthwise bending stresses imposed as timing lobe 30 urges the cam follower downwardly against the resistance offered by valve spring 22.

The compound structure comprised by the combination of insert 52 with the correspondingly shaped movable end 18 both strengthens the cam follower and adds height to the follower, as compared with the height obtainable from a cold-formed one-piece follower. The added height is valuable to an engine designer in stabilizing the follower's movements. The height addition provided by use of insert 52 in the inverted-U configuration of movable end 18 is apparent from FIG. 5 where downward face 54 of insert 52 is curved to a radius corresponding with the distance from a rocking axis 62, located approximately at the center of domed cap 49, while the supporting side walls 46 can be manufactured to extend downwardly to an extent which is as desired by the engine designer.

The useful "functional height" of the cam follower at movable end 18 relates to the extent of the side and inner surfaces of the lower extremities 53 in the area below downward face 54 of insert 52, noted in FIG. 5 as "FH". Attempts to form a stamped follower of comparable configuration and height, in one piece, without insert 52, are impractical, or result in a less rigid construction. For example, as may be envisaged from FIG. 5, were it practical to cold-form curved portion 58 of movable end 18 of follower body 10 to be displaced to the position of downward surface 54 of insert 52, side walls 46 would have little lateral support and there would be difficulties in forming lower extremities 53 that function to locate the cam follower on valve stem 20. Strength and rigidity can be enhanced by greater material thickness, at the expense of weight, but the overall height of the cam follower, transversely to the plane of the material from which it is formed would be reduced. Excessive bending or drawing to attain deep contours out of the material plane induces incipient weaknesses that may lead to premature mechanical failures or breakages. These difficulties are overcome by use of novel insert 52.

For economy and efficiency of manufacture, and to provide a lightweight, rigid, durable cam follower, cam follower body 10, 110, 210 or 310 is manufactured by cold-forming operations performed on laminar sheet or strip material. These operations may include steps such as stamping, bending, coining, staking, backpacking and the like, depending upon the cam follower's particular structure but, preferably, avoid difficult or expensive forming steps such as machining or milling. Insert 52 can similarly be manufactured by cold-forming, for example by stamping from strip or sheet material, and assembled with cam follower body 10 by any suitable process, for example, welding, furnace brazing with copper, or by use of an adhesive.

An example of a suitable material for cam follower body 10 is a 1010 steel in a thickness of about one-eighth of an inch, subjected to a carbonitride heat treatment to a hardness of minimum g0 R15N and an effective case depth of about 0.25 to 0.5 mm.

Figure 8:
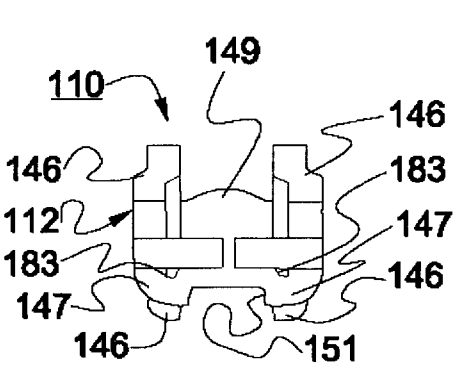
FIG. 8 is a right-hand end elevation of the cam follower as shown in FIG. 7, omitting the follower roller and the valve stem.
Figure 9:
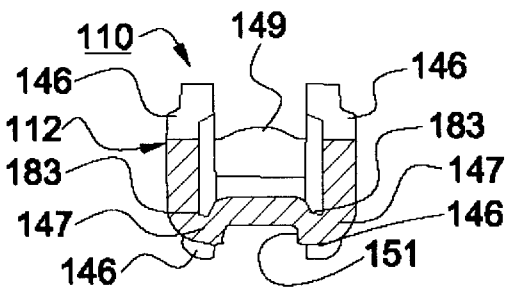
FIG. 9 is a sectional view on the line 9—9 of FIG. 7.
Figure 6:
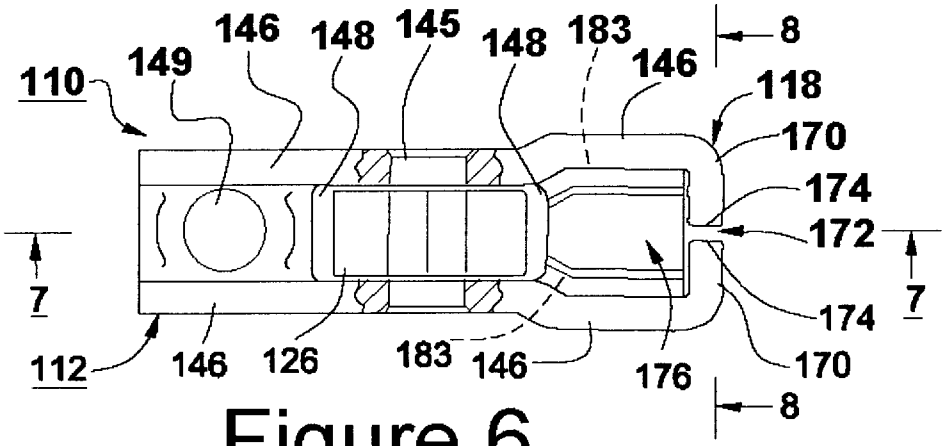
FIG. 6 is a top plan view, also partly sectioned, of a second embodiment of roller-type cam follower according to the invention useful in a valve-actuating mechanism such as that shown in FIG. 1.
Figure 7:
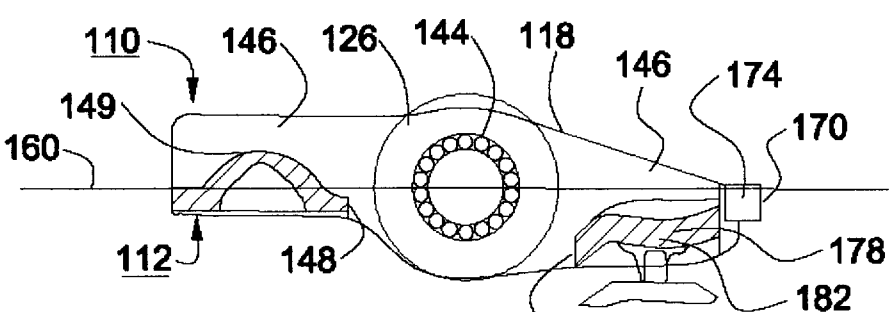
FIG. 7 is a section on the line 7—7 of FIG. 6, also showing a valve stem engaged and lubricated by the cam follower.

Referring to the second embodiment of the invention depicted in FIGS. 6–8, generally similar structural elements, or elements performing analogous, corresponding or identical functions to those of the cam follower of the first embodiment are given corresponding reference numerals distinguished from the reference numerals used in the first embodiment by a preceding one hundred numeral, thus "1NN". Corresponding structural elements in any further embodiments disclosed in subsequent figures are similarly referenced, using the next succeeding hundreds numeral. For the sake of brevity, description of such similar structural elements will not be repeated.

The second embodiment of cam follower depicted in FIGS. 6–9 has a similar support end 112 to that of the first embodiment but its movable end 118 comprises novel oiling structure, namely extensions of side walls 146 to wrap around the open end of cam follower body 110. These extensions provide two closing gates 170 which are configured to define a small oil feed slot 172 between their end faces 174. Closing gates 170 are of limited height, sufficient to retain oil in a small basin-like reservoir 176 between side walls 146 while not adding undue weight to the cam follower.

As viewed in FIG. 7, closing gates 170 lie approximately just beneath rocking axis 60. Cam follower body 10 has a bottom portion 178 in the vicinity of movable end 118 which bottom portion 178 extends generally parallel to rocking axis 60 and which is largely arcuately shaped and has an upper face 180 which is concavely curved to help retain oil in reservoir 176. Bottom portion 178 has a lower face 182 which is convexly curved to ride on valve stem 20 and has a downward lip 184 terminating in cutout 148. Side walls 146 have extensions 147 depending downwardly past bottom portion 178 to define a groove or channel 151 to receive valve stem 20 and locate the cam follower laterally with respect thereto. Bottom portion 178 is configured with drain channels 183 to encourage oil flow. Oil 186 collects in reservoir 176 and drizzles down through slot 172 across lower face 182 of the cam follower to valve stem 20, lubricating the contacting surfaces of the two components.

Referring now to FIGS. 10–14, the cam follower body 210 of the third embodiment of the invention is substantially similar to cam follower body 110 of the second embodiment (FIGS. 6–9), except that it lacks closing gates 170. Accordingly, movable end 218 is open-ended to receive a clip 284, preferably of spring steel, bronze or other suitable material, which clips over bottom portion 278 to add functional height to the cam follower.

Figure 13:
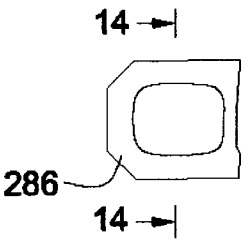
FIG. 13 is a plan view of the clip employed in the cam follower embodiment of FIGS. 10–12.
Figure 14:
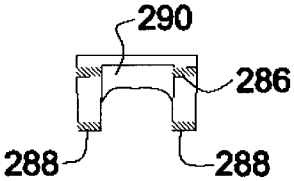
FIG. 14 is a section on the line 14—14 of FIG. 13.
Figure 10:
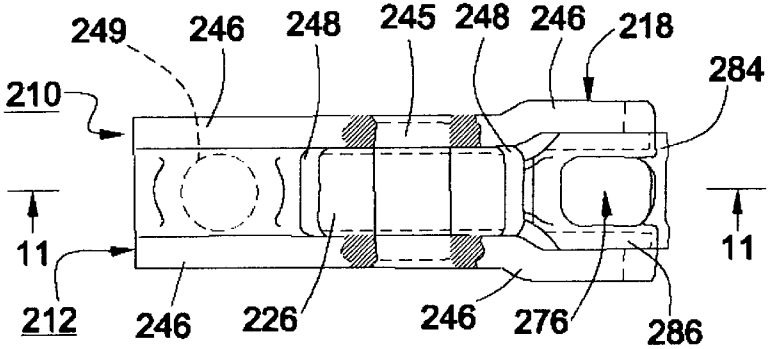
FIG. 10 is a top plan view, also partly sectioned, of a third embodiment of roller-type cam follower according to the invention which employs a clip to add height to the cam follower.

Clip 284 has a U-shaped configuration in one plane (FIG. 11) and a generally rectangular configuration in a plane perpendicular thereto (FIGS. 10 and 13). An upper portion of the clip comprises a cutout or annular frame 286, while a lower portion comprises a pair of fingers 288, the upper and lower portions being joined by a curved web 290 constituting the base of the U. Frame 286 fits over upper face 280 of bottom portion 278 and fingers 288 are positioned and dimensioned to overlie extensions 247 of sidewalls 246.

Figure 12:
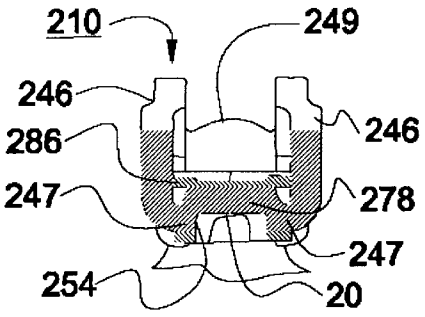
FIG. 12 is a section on the line 12—12 of FIG. 11, with part of a valve stem engaged by the cam follower.
Figure 11:
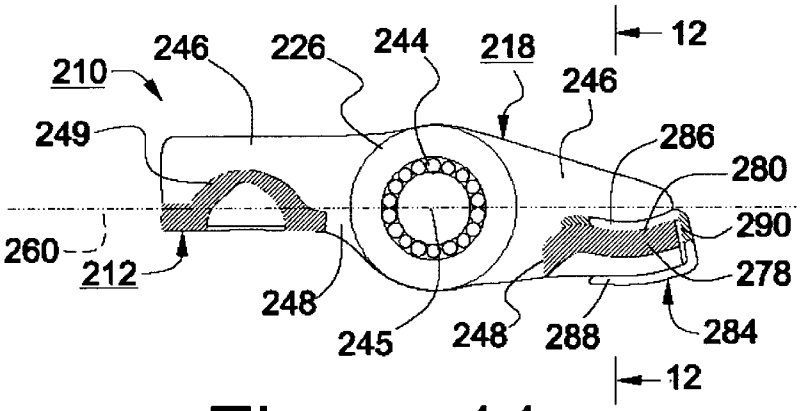
FIG. 11 is a section on the line 11—11 of FIG. 10.
Figure 15:
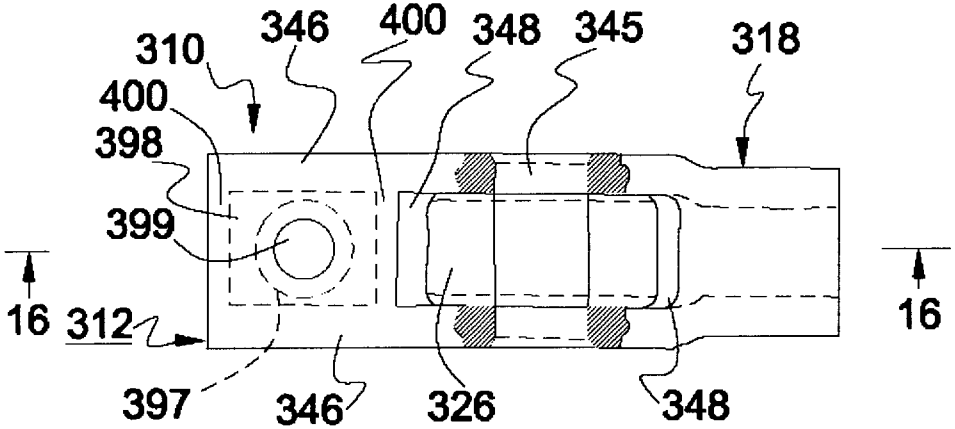
FIG. 15 is a top plan view, also partly sectioned, of a fourth embodiment of roller-type cam follower according to the invention which employs an insert to ensure proper engagement with the lifter post.

Preferably, as shown, clip 284 is curved in the plane of FIG. 11 to conform with bottom portion 278 of the cam follower movable end 218, and fit snugly thereon, and preferably also fingers 288 are spot-welded to extensions 247 of side walls 246 to affix clip 284 to cam follower body 210. Fingers 288 increase the functional height of the cam follower by their thickness (FIGS. 11 and 12). Frame 286 serves to retain oil in reservoir 276 and the motion of the cam follower coupled with normal engine vibration promotes viscous gravitational distribution of oil to the underside of bottom portion 278 and valve stem 20 to lubricate their relative motion.

Cam followers constructed according to this embodiment can be cold formed from sheet or strip material of sufficient thickness to provide good strength and durability while the addition of clip 284 provides desired additional height.

Figure 16:
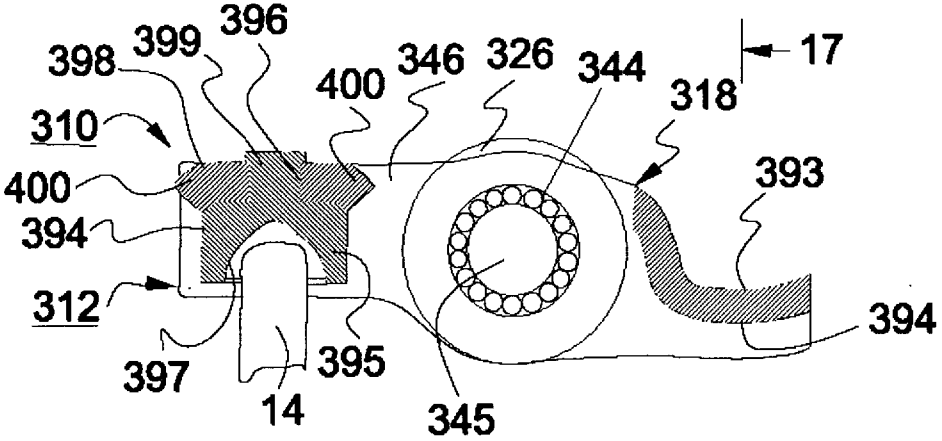
FIG. 16 is a section on the line 16—16 of FIG. 15.

Referring to FIGS. 15–18, the fourth illustrated embodiment of the invention employs a cam follower body 310 having a general configuration of an inverted channel so that cutout 348 which receives cam roller 326 is located on an upper side of the cam follower. In this case, at the movable end 318, an upper wall 392 extends between the tops of side walls 346 and the side elevational shape of side walls 346 descends rapidly downwardly approaching the outer extremity of movable end 318, as shown in FIG. 16. Side walls 346 and upper wall 392 thus define an inverted channel to receive and engage valve stem 20 with an underside 393 of upper wall 392 riding on valve stem 20, and thus generate functional wall height as required by the engine designer.

Movable end 318 is pressed downwardly out of its mother strip or sheet material to the maximum practical extent permissible by cold-forming without impairing structural strength and durability. Thus, undue stress that would weaken it, or breakage of any part of the structure must be avoided. Metallurgical limitations imply that with the illustrated configuration of movable end 318, and an inverted channel configuration, such as that depicted, support end 310 is necessarily raised in relation to axis 360, impeding proper lash adjustment at lifter post 14 (FIG. 16). Cold stamping techniques permit the material to be pressed in only one direction transversely of the length of the part.

To solve this problem, the invention provides insert means for adding height to the support end 310 above the lash adjuster 14, comprising a chimney-like socket 394 riveted, staked or pressed, into an opening 396 in a mounting plate 398 providing an upper wall to support end 310, extending between side walls 346. Mounting plate 398 is created in stamping follower body 310 with downturned lateral margins 400 defining claw-like edges 402 which engage and grip socket 394. The socket is positively located in the follower 310 by the side walls 346 and by the edges 402 of the lateral margins 400 of mounting plate 398.

Figure 18:
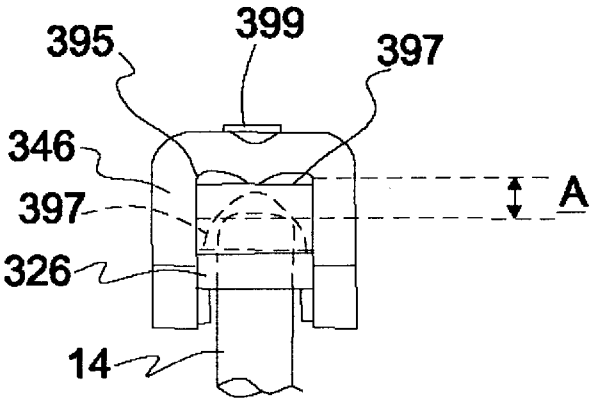
FIG. 18 is a left-hand end elevational view of the cam follower shown in FIG. 16.
Figure 17:
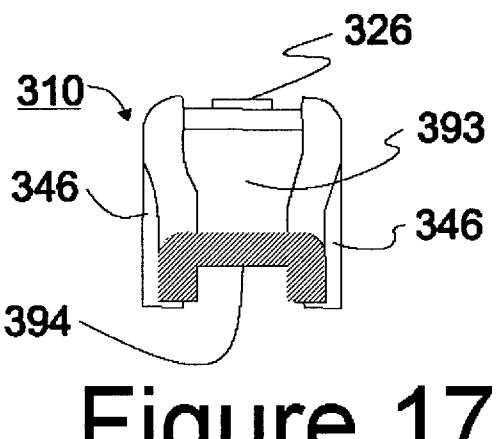
FIG. 17 is a section on the line 17—17 of FIG. 16.

Socket 394 comprises a body portion 395 having a cup-like or paraboloidal cavity 397 to receive lifter post 14 and a vertical post 399 engaging in opening 396 to secure socket 394 to mounting plate 398. Socket 394 effectively adds height to the cam follower. If lifter post 14 would otherwise engage an upper wall of support end 318, in the position of mounting plate 398, the added height is represented by the downward displacement of the point of engagement of lifter post 14 with the cam follower, which as shown is approximately half way up cavity 397. This displacement is shown in FIG. 18, referenced A, and permits proper lash adjustment of lifter post 14.

In each of the herein described embodiments, the design of the inventive cam follower provides good structural rigidity and durability, supporting the cam follower roller for efficient translation of passes of the engaged cam lobe 30 into accurately timed reciprocatory valve action. Furthermore, the simple, open configuration of the cam follower body 10-310 is well suited to economical cold-forming production, by stamping, for example from a steel such as a carbo-nitride treated steel.

A cylinder head of an internal combustion engine of the overhead valve type can be enhanced by incorporation of embodiments of the herein described inventive cam followers, providing design flexibility and user benefits.

While some illustrative embodiments of the invention have been described above, it is, of course, understood that various modifications and equivalents of the described embodiments will be apparent to those of ordinary skill in the art. Some equivalents will be readily recognized by those of ordinary skill while others may require no more than routine experimentation. Such modifications and equivalents are within the spirit and scope of the invention, which is limited and defined only by the appended claims.

We claim:

1. A roller-type, internal combustion engine cam follower for an overhead cam engine having a camshaft located above a plurality of engine valves, the cam follower comprising:

a) a cold-formed one-piece cam follower body having:

i) a U-shaped support end to support the cam follower on a lifter post in a generally upright position with respect to the lifter post;

ii) a movable end having an inverted U-shaped section defined by sidewalls and being oriented so that the open U faces toward one of the engine valves; and iii) a cutout between said support end and said movable end;

b) a roller mounted on the cam follower body to extend through the cutout for engagement with a cam; and c) a valve-contacting insert element positioned in the inverted U-shaped section of the movable end to be engageable with the valve stem.

2. A cam follower according to claim 1 wherein the movable end has an inverted channel-shaped structure and the insert conforms with and is located in said inverted channel-shaped structure and is positioned for engagement with the valve stem.

3. A cam follower according to claim 2 wherein the movable end and the insert are arcuate being upwardly concave, and wherein the insert has a convexly curved valve-stem engaging surface.

4. A cam follower according to claim 2 wherein the support end is channel-shaped in an upwardly open sense and is provided with a domed cap to fit over the lifter post.

5. A cam follower according to claim 1 wherein the insert element is monolithic, extends between, and is secured to, the sidewalls of the movable end, partially infilling the inverted U-shaped section of the movable end and providing a surface between the sidewalls engageable with said one valve, said insert surface riding on said valve during operation of the cam follower.

6. A cam follower according to claim 5 wherein the sidewalls have terminal portions extending past the insert to embrace the valve and locate the cam follower transversely of the direction of movement of the valve.

7. A cam follower according to claim 6 wherein the insert is a close fit between the sidewalls and is secured to the sidewalls by adhesive, welding or brazing to be essentially integral with the cam follower body.

8. A cam follower according to claim 7 wherein the movable end comprises opposed sidewall continuation portions which extend transversely of the sidewalls to provide a bottom wall portion of said inverted U-shaped section.

9. A cam follower according to claim 8 wherein the sidewall continuation portions define a slit along said bottom wall portion between the sidewall continuation portions.

10. A cam follower according to claim 1 wherein the insert element is monolithic, extends between, and is secured to, the sidewalls of the movable end, partially infilling the inverted U-shaped section of the movable end and providing a surface between the sidewalls engageable with said one valve, said insert surface riding on said valve during operation of the cam follower, wherein the sidewalls have terminal portions extending past the insert to embrace the valve and locate the cam follower transversely of the direction of movement of the valve, wherein the insert is a close fit between the sidewalls and is secured to the sidewalls by adhesive, welding or brazing to be essentially integral with the cam follower body, wherein the movable end comprises opposed sidewall continuation portions which extend transversely of the sidewalls to provide a bottom wall portion of said inverted U-shaped section and wherein the sidewall continuation portions define a slit along said bottom wall portion between the sidewall continuation portions.

11. A cam follower according to claim 10 wherein the movable end and the insert are arcuate being upwardly concave, and wherein the insert has a convexly curved valve-stem engaging surface.

12. A cam follower according to claim 10 wherein the support end is channel-shaped in an upwardly open sense and is provided with a domed cap to fit over the lifter post.

13. A roller-type, internal combustion engine cam follower for an overhead cam engine having a camshaft located above a plurality of engine valves, the cam follower comprising:

a) a cold-formed one-piece cam follower body having:

i) a U-shaped support end to support the cam follower on a lifter post in a generally upright position with respect to the lifter post;

ii) a movable end to engage a valve stem, said movable end having an inverted U-shaped section defined by sidewalls, being oriented so that the open U faces toward one of the engine valves and having opposed sidewall continuation portions which extend transversely of the sidewalls to provide a bottom wall portion of said inverted U-shaped section and define a slit along said bottom wall portion between the sidewall continuation portions; and iii) a cutout between said support end and said movable end;

b) a roller mounted on the cam follower body to extend through the cutout for engagement with a cam; and c) a valve-contacting, monolithic insert element positioned in the inverted U-shaped section of the movable end to be engageable with the valve stem, said insert element being a close fit between, and being secured to, the sidewalls of the movable end by adhesive, welding or brazing so as to be essentially integral with the cam follower body, partially infilling the inverted U-shaped section of the movable end and providing a surface between the sidewalls engageable with said one valve, said insert surface riding on said valve during operation of the cam follower;

wherein the sidewalls have terminal portions extending past the insert to embrace the valve and locate the cam follower transversely of the direction of movement of the valve and wherein the movable end and the insert are arcuate being upwardly concave, and wherein the insert has a convexly curved valve-stem engaging surface.

14. A cam follower according to claim 13 wherein the support end is channel-shaped in an upwardly open sense and is provided with a domed cap to fit over the lifter post.

15. A roller-type, internal combustion engine cam follower, comprising a main body member formed from a sheet metal member, said main body member, comprising:

a) a first end portion, terminating in a first end at one end of said main body member;

b) a second end portion, terminating in a second end at an end of said main body member opposite said first end, said first and second end portions substantially defining a continuous two dimensional shape;

c) a first side portion extending from said first end to said second end on one side of said main body, said first side portion being oriented in a direction transverse to said shape;

d) a second side portion extending from said first end to said second end on a side of said main body opposite said first side portion, said second side portion being oriented in a direction transverse to said shape and extending in the same direction as said first side portion, said first and second side portions and said first end portion defining a concave shape, proximate to said first end portion, said concave shape configured to engage a first cam follower engaging element, and said concave shape having a first orientation;

e) a first side portion extension extending from said first side portion adjacent said second end, said first side portion extension being oriented in a direction transverse to said first side portion and extending toward said second side portion; and f) a second side portion extension extending from said second side portion adjacent said second end, said second side portion extension being oriented in a direction transverse to said second side portion, and extending toward said first side portion and said first side portion extension; said first and second side portion extension being bent toward each other during formation of the cam follower, and together with said first and second side portions defining an inverted concave shape, proximate to said second end portion, said inverted concave shape having a second orientation, said second orientation being substantially opposite said first orientation, and said inverted concave shape being configured to engage a second cam follower engaging element; said second end portion defining an open area between said first and second side portions, said open area being configured and dimensioned to allow said inverted concave shape to engage said second cam follower engaging element.

16. A cam follower as in claim 15, wherein said concave shape is configured with an indentation configured, positioned and dimensioned to engage a lifter post in an overhead cam engine.

17. A cam follower as in claim 15, wherein said inverted concave shape is configured to engage a valve stem in an overhead cam engine.

18. A cam follower as in claim 17, wherein said inverted concave shape is configured to engage a valve stem in an overhead cam engine by an insert secured within said inverted concave shape.

19. A cam follower as in claim 18, wherein said concave shape is configured with an indentation configured, positioned and dimensioned to engage a lifter post in an overhead cam engine.

20. A cam follower as in claim 15, wherein said inverted concave shape is configured to engage a valve stem in an overhead cam engine by an insert secured within said inverted concave shape.

* * * * *